United States Patent [19]

Mune et al.

[11] Patent Number: 4,934,948

[45] Date of Patent: Jun. 19, 1990

[54] LOAD TERMINAL CONFIGURATION FOR CIRCUIT BREAKER OR THE LIKE

[75] Inventors: Charles Mune, West Hartford; Michael A. Fasano, Watertown, both of Conn.

[73] Assignee: Carlingswitch, Inc., Plainville, Conn.

[21] Appl. No.: 335,138

[22] Filed: Apr. 6, 1989

[51] Int. Cl.[5] ..... H01R 4/34

[52] U.S. Cl. ..... 439/217; 439/801; 439/907

[58] Field of Search ..... 361/353, 361, 363, 372–376; 439/217–224, 801, 907

[56] References Cited

U.S. PATENT DOCUMENTS 2,199,626 5/1940 Freese ..... 361/353

2,701,870 2/1955 Obszarny ..... 439/801

3,066,204 11/1962 Mobarry ..... 439/217

*Primary Examiner*—Neil Abrams

*Attorney, Agent, or Firm*—McCormick, Paulding & Huber

[57] ABSTRACT

A circuit breaker terminal strip has an offset spade terminal end segment and a conventional lug terminal segment formed integrally so that one or the other or both types of wire connectors can be used with a single terminal. The lug receiving segment has a threaded opening to receive a screw that holds the lug and its wire in alignment with the terminal. The spade segment is integrally connected to the lug receiving segment and configured to receive a quick connector so that the wire on the latter does not interfere with the wire with the lug.

4 Claims, 1 Drawing Sheet

LOAD TERMINAL CONFIGURATION FOR CIRCUIT BREAKER OR THE LIKE

BACKGROUND OF THE INVENTION

This invention relates generally to improvements in the terminals provided in a circuit breaker such that a single terminal can be electrically connected to at least two different wire ends associated with two different electrical circuits.

Electromagnetic circuit breakers generally are provided with electrical terminals of several different configurations. For example, some circuit breaker terminals are adapted to receive lug type connectors while other terminals are adapted to receive quick connect wire ends. Those circuit breakers that are fitted With terminals adapted to receive a wire lug connector generally have a screw that passes through an opening defined in a swaged fitting. The screw is in turn threadably received in the terminal itself. Other wire end configurations may include a simple bared Wire adapted to be clamp in a heavy duty connector.

This invention relates to an improvement whereby a single strip terminal is provided with the capability of receiving either a wire lug end fitting or a quick connect type of coupling or both at the same time.

SUMMARY OF THE INVENTION

In accordance with the present invention a conventional circuit breaker housing is provided with electrical terminals that are coupled to an internally mounted circuit breaker mechanism. The breaker mechanism operates electrical contacts, one of which is adapted to be opened by said mechanism in response to an over voltage and/or current condition. The present invention deals with an improvement to at least one of the electrical terminals. More specifically at least one of said electrical terminals is preferably formed from an initially flat strip that includes an internal portion and an external portion. An intermediate portion integrally connects both said internal and external portions, and is adapted to be secured in the circuit breaker housing side wall or bottom wall. A typical circuit breaker housing is fabricated from two half sections so that the terminal strip is locked in aligned slots provided in each of these half sections. The internal portion of the terminal preferably includes conventional means for electrically coupling the terminal to an electromagnetic coil provided as part of the circuit breaker mechanism, but it could also be provided for electrically connecting the terminal to other components of the circuit breaker mechanism inside the housing.

The external portion of the terminal includes a wire lug receiving segment that defines an opening for a screw that secures a conventional wire lug to such wire lug receiving segment. This wire lug receiving segment may include means for properly locating the wire lug relative to the terminal and in a typical installation the wire lug will be generally aligned with the elongated terminal strip that actually defines the wire lug receiving segment.

In further accordance with the present invention a free end segment of the terminal's external portion is located outwardly of the wire lug receiving segment and defines a spadelike protuberance for receiving a quick connector of conventional configuration. This free end segment is preferably offset from the plane of the wire lug receiving segment so as to permit both a wire lug and a quick connector to be simultaneously received on a single terminal.

DETAILED DESCRIPTION

Figure 1:
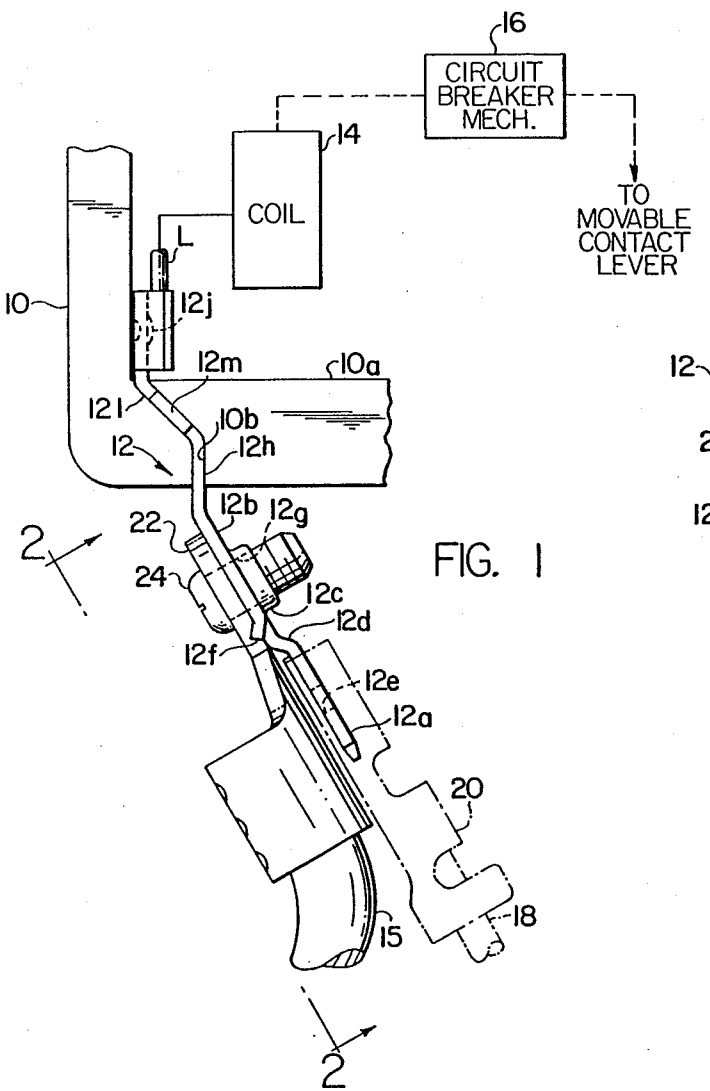
FIG. 1 is a front elevational view with portions of the circuit breaker housing illustrated in section to reveal the strip type terminal fitted with a wire lug connector and a quick connect coupler device in accordance with the present invention.

Turning now to the drawing in greater detail, FIG. 1 shows a portion of a typical circuit breaker housing 10, which housing has a bottom wall **10*a* that is defined by mating marginal edge portions of the circuit breaker half sections. These half sections define aligned slots 10*b* for receiving a circuit breaker terminal strip such as indicated generally on 12. The terminal strip 12 serves to electrically connect an internal electromagnetic coil 14 with an electrical load (not shown) through a lead or wire 15 in order to provide load current and voltage to the coil 14. The coil's other end is connected to a movable contact (not shown) associated with another electrical circuit breaker terminal (not shown) at least during normal operation of the circuit breaker itself. When an overload or overcurrent condition is present the coil 14 causes an armature to trip, and through a conventional circuit breaker mechanism 16 causes the lever on which the movable contact is mounted to open. The result is to open the circuit and interrupt the flow of electrical energy through line 15**.

Strip type load terminals have been available for some time in circuit breakers of this type but the load terminal of the present invention differs from prior art load terminals in that additional means is provided for electrically connecting a second lead or wire 18 to the load terminal by means of a spadelike protuberance defined at a free end segment **12*a* of the load terminal 12. This free end spade segment 12*a* is offset from the terminal segment 12*b* that supports the wire lug 22 and can be seen from FIG. 1 to thereby avoid interference with the load line or wire 15 and its associated lug 22. The wire lug connector 22 is conventionally secured to the load terminal by means of a screw 24 that is received in an opening defined for it in the wire lug 22. The screw 24 is threadably received in an opening defined by upset annular boss 12*c* of the wire lug receiving segment 12*b*. As so constructed and arranged it will be apparent that the plane of the lug receiving segment 12*b* is in fact offset from the plane of the spade connector segment 12*a* by portion 12*d*. FIG. 1 illustrates this feature and clearly shows the clearance provided between the wire lug 22 and the connector 20 associated with the leads 15 and 18** respectively.

Figure 2:
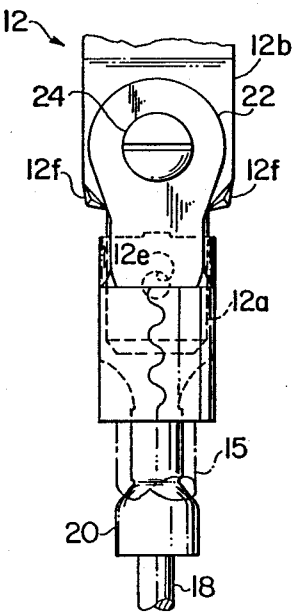
FIG. 2 is a side elevational view taken generally on the line 2—2 to of FIG. 1.

FIG. 2 shows the exposed external portion of the terminal 12 and more particularly the segment **12*b* for receiving the wire lug 22, and the offset spade free end portion 12***a* of the terminal for receiving the quick connect coupler 20. The screw 24 is also shown in FIG. 2 and serves to secure the wire lug 22 to its associated terminal segment.

Figure 3:
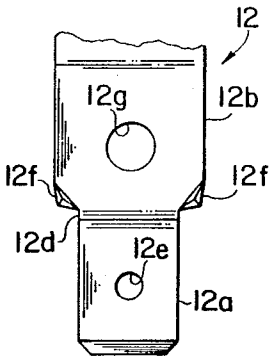
FIG. 3 is a side elevational view showing the external portion of the terminal outside the circuit breaker case and without the wire lug and quick connect coupling secured thereto.

FIG. 3 illustrates the exposed or external portion of the terminal without the wire segment and quick connect coupler attached. This view illustrates the threaded opening 12*g* in the boss for receiving the screw 24. This view also shows the configuration for the spade shaped free end segment 12*a* of the terminal that is appropriately sized and configured for receiving the quick connect coupler (not shown). An opening is preferably provided in this spade terminal end segment as indicated generally 12*e* to facilitate a solder connection to a wire that is not fitted with a quick connect coupler 20. FIG. 3 also illustrates the upturned locator tabs 12*f* and 12*f* for locating the lug 22 in alignment with the center line of the terminal itself.

Figure 4:
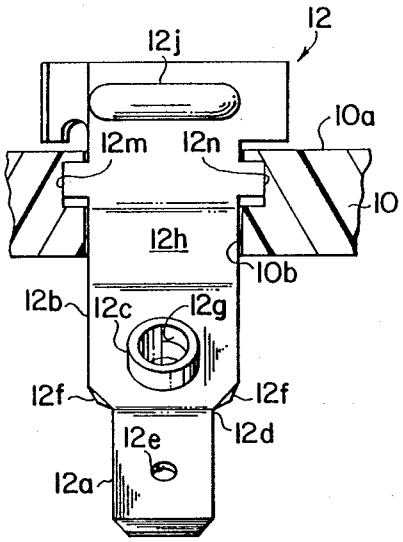
FIG. 4 is a right hand side view illustrating the terminal of FIGS. 1, 2, 3 again without the wire lug and quick connect couplings, but does show in part the circuit breaker housing.

Finally, FIG. 4 illustrates the overall configuration for the terminal strip 12 and it will be apparent from this view that the upper portion is located inside the circuit breaker housing and that an intermediate portion 12*h* is adapted to be received in aligned slots provided for this purpose in the housing half sections in accordance with conventional terminal mounting practice. Tabs 12*m* and 12*n* serve to anchor the terminals in the housing. This view also illustrates the internal portion of the terminal as configured to facilitate clamping of the internal terminal portion to the conductive lead L associated with the coil 14 inside the circuit breaker housing. A raised portion 12*j* of this internal terminal portion serves to facilitate anchoring the conductive lead L in place by clamping, or by soldering or both, the end of the lead L to this internal portion of the terminal 12. The external terminal portion is unique and has the lug receiving segment 12*b* plus the offset spadelike end segment all as described above and as claimed below. Note also that the terminal strip 12 includes a bend 121 that also serves to anchor the terminal in the housing in cooperation with the tabs 12*m* and 12*n*.

We claim:

1. In a circuit breaker having a housing and electrical terminals coupled to internal electrical contacts through an internal circuit breaker mechanism for achieving the opening of these contacts, the improvement to at least one circuit breaker terminal characterized by; internal and external terminal portions, and an intermediate terminal portion integrally connecting said internal and external portions, said external portion including a wire lug receiving segment defining a threaded opening for releasably securing a wire lug to said wire lug receiving segment, said wire lug receiving segment located adjacent said intermediate terminal portion and extending outwardly of said housing in one direction, and said terminal external portion further including a free end segment located outwardly of said wire lug receiving segment in the same direction to define a spade for receiving a quick connect coupling whereby both the quick connect coupling and the wire lug can be secured to the external terminal portion from the same direction without interferring with one another.

2. The combination of claim 1 wherein said terminal further includes tabs for securing said terminal to said housing, said housing being composed of mating half sections that define slots alignable with one another for so receiving said terminal intermediate portion.

3. The combination of claim 1 wherein said wire lug receiving segment further includes wire lug locating tabs to facilitate mounting of the wire lug to the terminals so that the wire lug is aligned generally with the terminal itself.

4. The combination of claim 1 further characterized by said terminal being fabricated from an initially flat strip of conductive metal, said strip having said offset portion integrally defined between said quick connect spade segment thereof and said wire lug receiving segment thereof.

* * * * *